US010184638B2

(12) United States Patent
Chai

(10) Patent No.: US 10,184,638 B2
(45) Date of Patent: Jan. 22, 2019

(54) LED PLANE LIGHT SOURCE LAMP

(71) Applicant: Kao-Teh Chai, Taipei (TW)

(72) Inventor: Kao-Teh Chai, Taipei (TW)

( * ) Notice: Subject to any disclaimer, the term of this patent is extended or adjusted under 35 U.S.C. 154(b) by 0 days.

(21) Appl. No.: 15/497,257

(22) Filed: Apr. 26, 2017

(65) Prior Publication Data

US 2018/0266651 A1 Sep. 20, 2018

(30) Foreign Application Priority Data

Mar. 20, 2017 (TW) ..... 106109151 A

(51) Int. Cl.

| | |
|---|---|
| ***F21V 7/22*** | (2018.01) |
| ***F21V 23/00*** | (2015.01) |
| ***F21V 3/06*** | (2018.01) |
| ***F21V 3/02*** | (2006.01) |
| ***F21V 19/00*** | (2006.01) |
| ***F21V 23/02*** | (2006.01) |
| *F21Y 115/10* | (2016.01) |
| *F21Y 105/16* | (2016.01) |

(52) U.S. Cl.

CPC ..... *F21V 3/0625* (2018.02); *F21V 3/02* (2013.01); *F21V 19/003* (2013.01); *F21V 23/02* (2013.01); *F21Y 2105/16* (2016.08); *F21Y 2115/10* (2016.08)

(58) Field of Classification Search

CPC ..... F21V 23/003; F21V 23/002; F21V 3/049; F21V 3/0625

See application file for complete search history.

(56) References Cited

U.S. PATENT DOCUMENTS

| | | | |
|---|---|---|---|
| 2005/0116235 | A1 | 6/2005 | Schultz et al. |
| 2008/0101065 | A1 | 5/2008 | Hsu et al. |
| 2013/0070455 | A1 | 3/2013 | Tsui et al. |
| 2013/0094212 | A1 | 4/2013 | Kim |
| 2014/0009941 | A1* | 1/2014 | Cho ..... H01L 23/544 362/293 |

FOREIGN PATENT DOCUMENTS

| | | | |
|---|---|---|---|
| CN | 201237123 | Y | 5/2009 |
| EP | 1742522 | A2 | 10/2007 |
| JP | 2012032537 | A | 2/2012 |
| JP | 2016054267 | A | 4/2016 |
| KR | 100985505 | B1 | 10/2010 |
| TW | M366176 | U1 | 10/2009 |
| TW | 201018845 | A | 5/2010 |
| TW | 201207303 | A | 2/2012 |
| TW | M423921 | U1 | 3/2012 |
| TW | M443814 | U1 | 12/2012 |
| TW | 201508206 | A | 3/2015 |
| WO | 2011004625 | A1 | 1/2011 |
| WO | 2016148087 | A1 | 9/2016 |

* cited by examiner

*Primary Examiner* — Karabi Guharay

(74) *Attorney, Agent, or Firm* — Bacon & Thomas, PLLC

(57) ABSTRACT

The present invention provides an LED plane light source lamp, which includes a bottom plate; four side plates set on four sides of the bottom plate, respectively; a plurality of circuit boards set on the bottom plate symmetrically and electrically connected to each other in parallel; a plurality of LEDs set on the bottom plate and arranged in an array; a power supply set on the bottom plate and providing electrical power to the LEDs; and a fogging film set opposite to the bottom plate on the side plates; wherein the fogging film scatters the lights of the LEDs to provides a uniform plane light source.

7 Claims, 15 Drawing Sheets

LED PLANE LIGHT SOURCE LAMP

BACKGROUND OF THE INVENTION

1. Field of the Invention

The present invention relates to a light emitting diode lamp.

2. Description of Related Art

A light emitting diode (LED) is a semiconductor device that can emit light. When an LED is electrified, the electrons and the holes in the LED will recombine, and then the electrons will fall from a higher energy level to a lower energy level, and the photos will be released during the process. As compared to an incandescent light bulb, which emits light by thermal radiation, an LED has higher luminous efficiency, and is advantageous for energy conservation and environmental protection.

FIG. 16 shows a prior art LED tube 100. In the LED tube 100, a plurality of LEDs 102 are connected in series with one another on a substrate 101, and are protected by a glass cover 103. However, the LEDs 102 will emit light directly out of the glass cover 103, and as a result, the LED tube 100 cannot provide soft light. Besides, the LEDs 102 are spaced out discretely, so that the LED tube 100 cannot provide a uniform light field, and thus cannot be an ideal plane source. Therefore, the prior art LED tube is subject to be improved.

SUMMARY OF THE INVENTION

In light of the above, the present invention provides a light emitting diode plane source lamp, comprising a substrate; four side plates set on four sides of the substrate and perpendicular to the substrate; a plurality of circuit boards symmetrically set on the substrate and connected to each other in parallel; a plurality of light emitting diodes set on each circuit board and arranged as a matrix on the circuit board; a power supplier set on the substrate and providing electrical power to the light emitting diodes; and a fogging film set on the side plates and opposite to the substrate. The fogging film scatters the lights of the light emitting diodes to provide a uniform plane source.

Besides, in further embodiments of the present invention, it is noted that the fogging film has a non-linear relation between an illuminance of its incident surface and a luminous exitance (or luminous emittance) of its emergent surface, and that the luminous exitance of the fogging film can be optimized by adjusting parameters including a radiant flux of each light emitting diode, a distance between any two adjacent light emitting diodes and a height between each light emitting diode and the fogging film, on purpose of energy conservation and environmental protection.

Other objects, novel features and advantages of the present invention will become more apparent from the following detailed description when taken in conjunction with the accompanying drawings.

DETAILED DESCRIPTION OF THE PREFERRED EMBODIMENT

Figure 1:
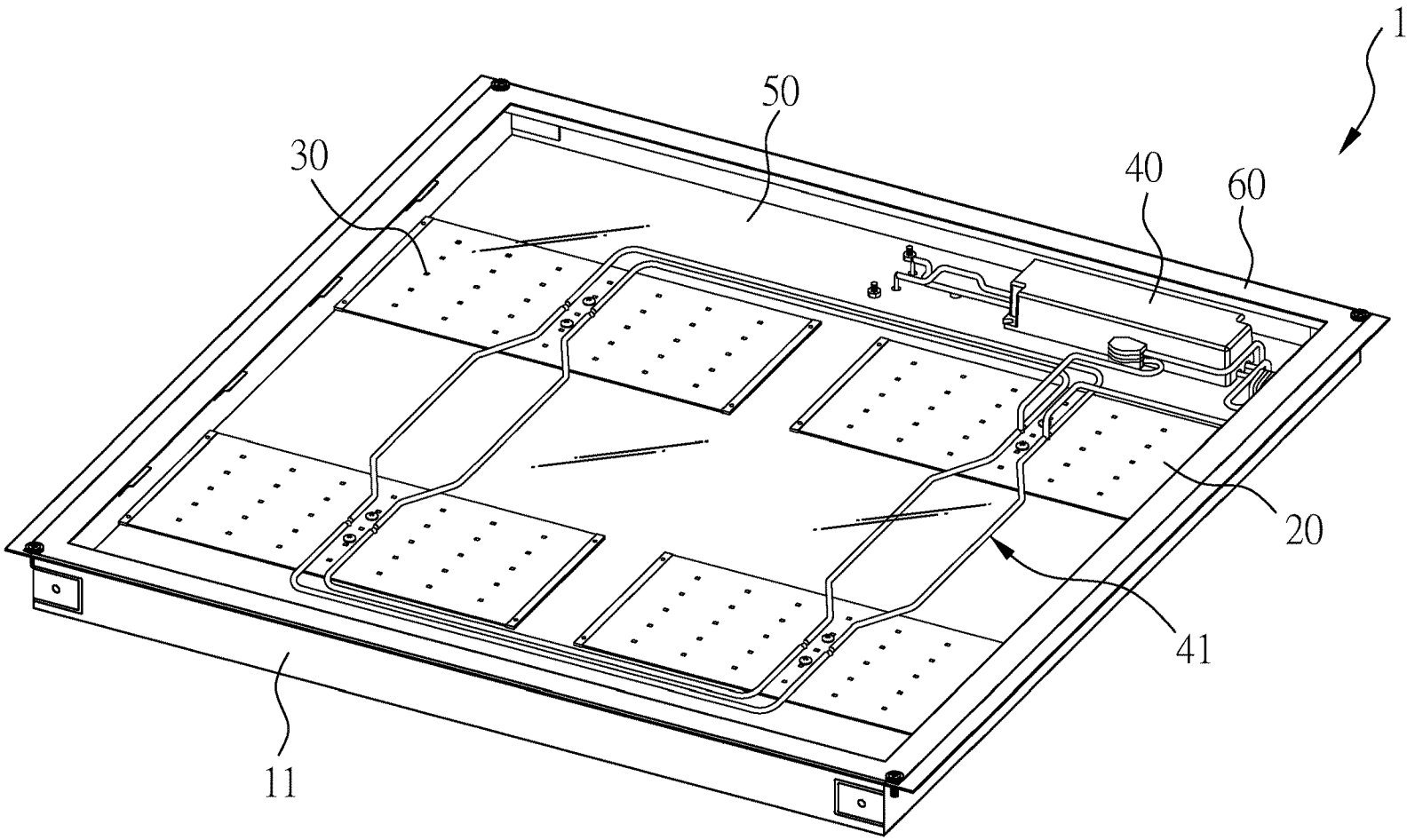
FIGS. 1 to 4 are a perspective view, an exploded view, a top perspective view and bottom perspective view of a light emitting diode plane source lamp, respectively, according to a first embodiment of the present invention.

Different embodiments of the present invention are provided in the following detailed description. These embodiments are not meant to limiting. It is possible to make modifications, replacements, combinations, separations or designs with the features of the present invention to apply to other embodiments.

First Embodiment

FIGS. 1 to 4 are a perspective view, an exploded view, a top perspective view and a bottom perspective view of a light emitting diode plane source lamp 1, respectively, according to a first embodiment of the present invention. References are made to FIGS. 1 to 4.

In this embodiment, the light emitting diode plane source lamp 1 mainly includes a substrate 10, four side plates 11, four circuit boards 20, a plurality of light emitting diodes 30, a power supplier 40 and a fogging film 50.

The substrate 10 is rectangular, so that it can be easily installed in a ceiling or a wall. The four side plates 11 are set on four sides of the substrate 10, respectively, and they are perpendicular to the substrate 10. The fogging film 50 is set on the four side plates 11 and opposite to the substrate 10. Therefore, the substrate 10, the four side plates 11 and the fogging film 50 form a container space.

Figure 2:
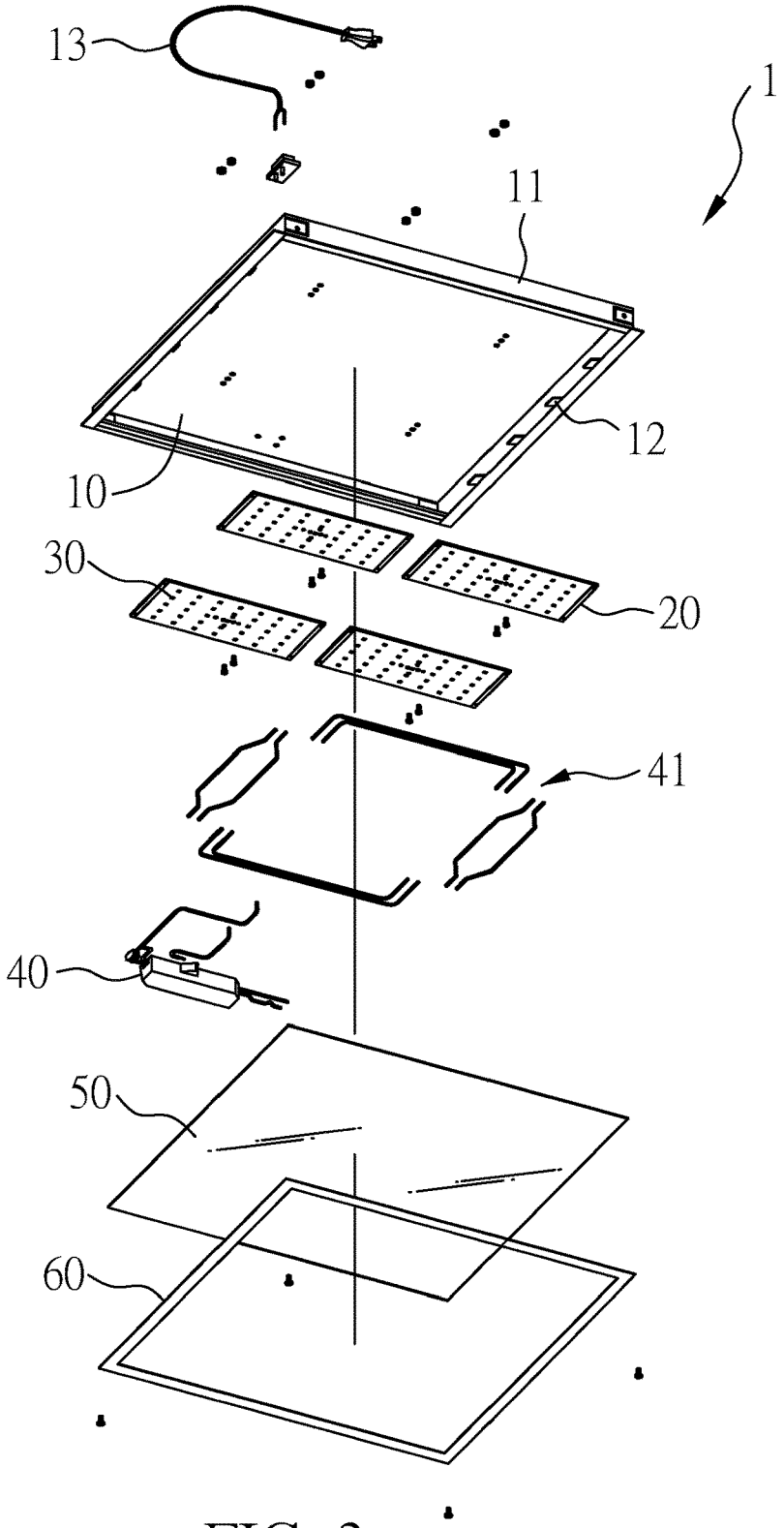
Figure 3:
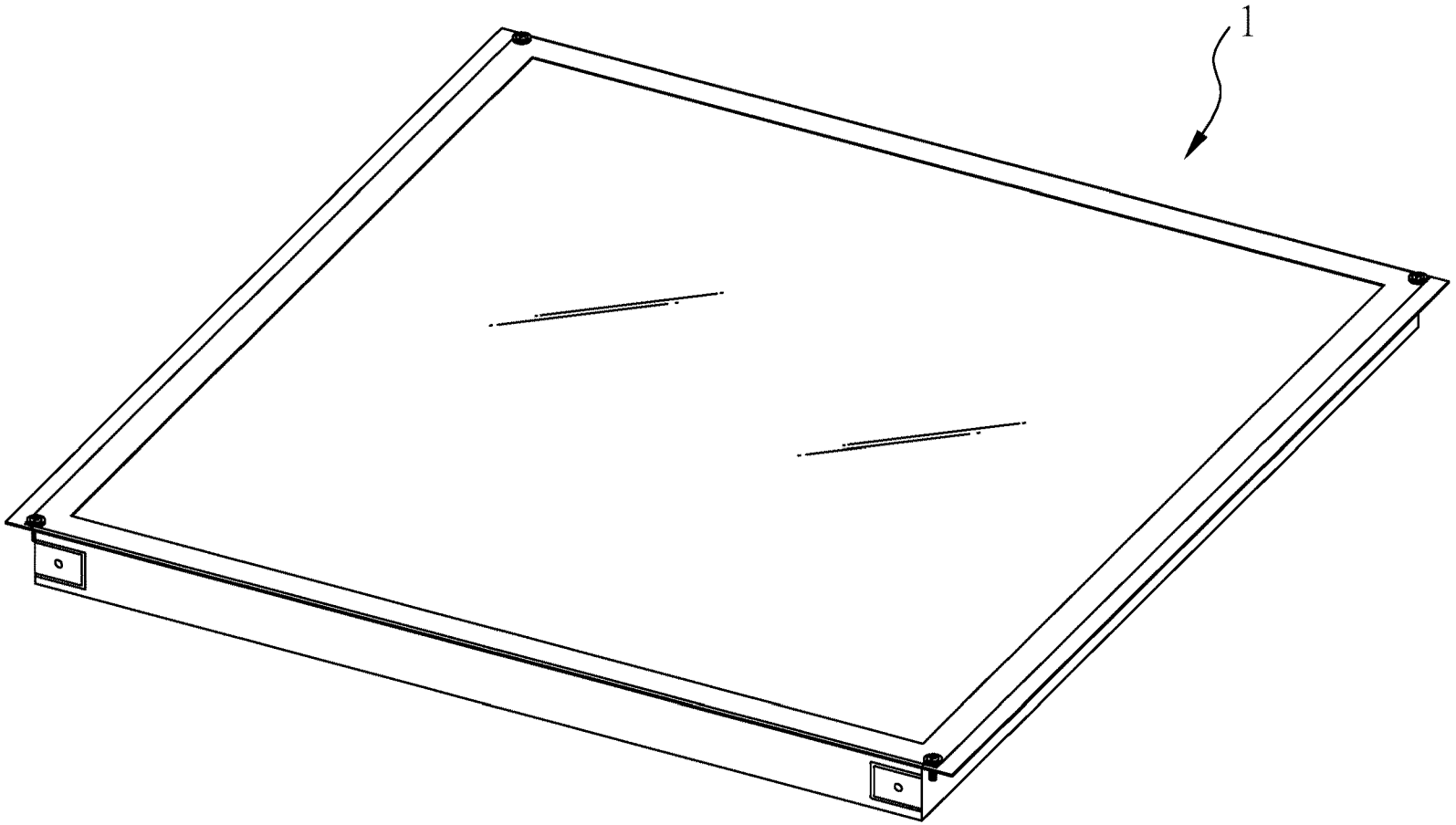
Figure 4:
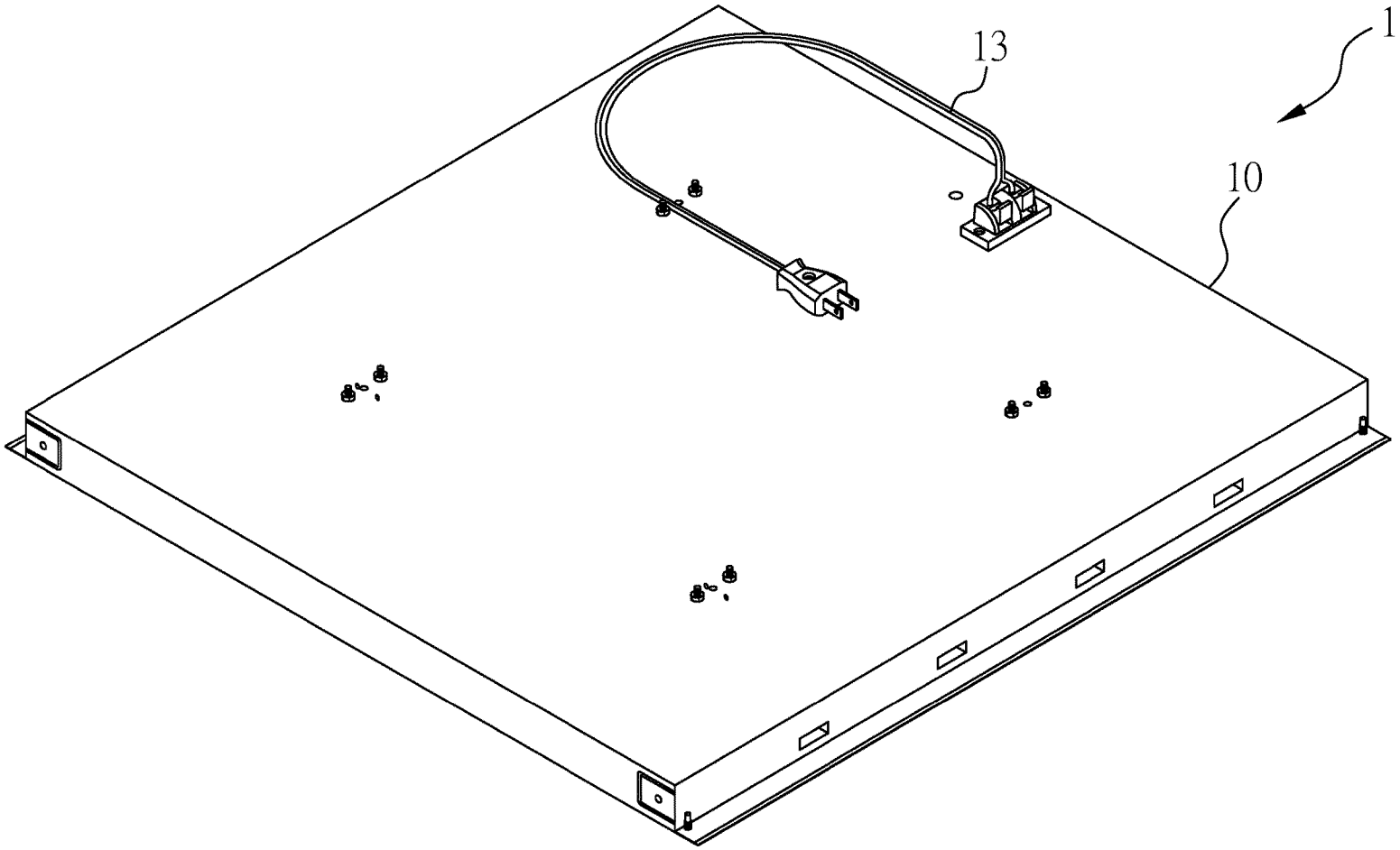

Selectively, the setting of fogging film 50 can be achieved by setting a frame 60 on the four side plates 11, and then inserting the fogging film 50 into the frame 60. As shown in FIGS. 2 and 4, a plug wire 13 can be set out of the container space, and it extends into the container space from a hole on the substrate 10. The material of the substrate 10 or the side plates 11 can be ceramic or metal, such as aluminum, copper or the alloy thereof, to improve heat conduction. One or some or each of the substrate 10, the side plates 11 and fogging film 50 can have holes, so that the air can flow into or out of the container space to improve heat dissipation by convection. FIGS. 2 and 4 show the side boards 11 having holes 12.

In measurement, the temperature of the circuit board of the light emitting diode plane source lamp 1 of the present invention is 25° C. to 30° C., which is lower than the temperature of the prior art LED tube. This shows an advantage provided by the present invention.

In the container space, four circuit boards 20 are fixed on the substrate 10, and they are horizontally symmetric and vertically symmetric. They are electrically connected to each other in parallel and are connected to a power supplier 40 by wires 41. The power supplier 40 can be connected to supply mains by a plug wire 13.

A plurality of light emitting diodes 30 are set on each circuit board 20 and arranged as a matrix on each circuit board. In this embodiment, the light emitting diodes 30 on each circuit board 20 are arranged as a matrix of 7 rows and 5 columns. In other embodiments, the matrix can have a different number of rows and a different number of columns. There is a distance D (which can be defined in a vertical direction or a horizontal direction) between two adjacent light emitting diodes 30. The light emitting diode 30 can emit white light, warm light or the combination thereof.

Each light emitting diode 30 has a radiant flux W. Each light emitting diode 30 can emit light in a range of angles defined by Lambertian distribution or Gaussian distribution.

Figure 5:
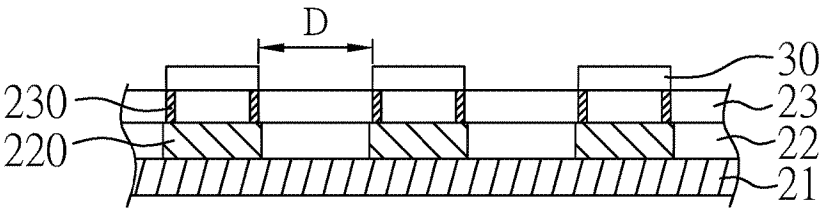
FIG. 5 is a sectional view of the circuit board of the light emitting diode plane source lamp according to the first embodiment of the present invention.
Figure 6:
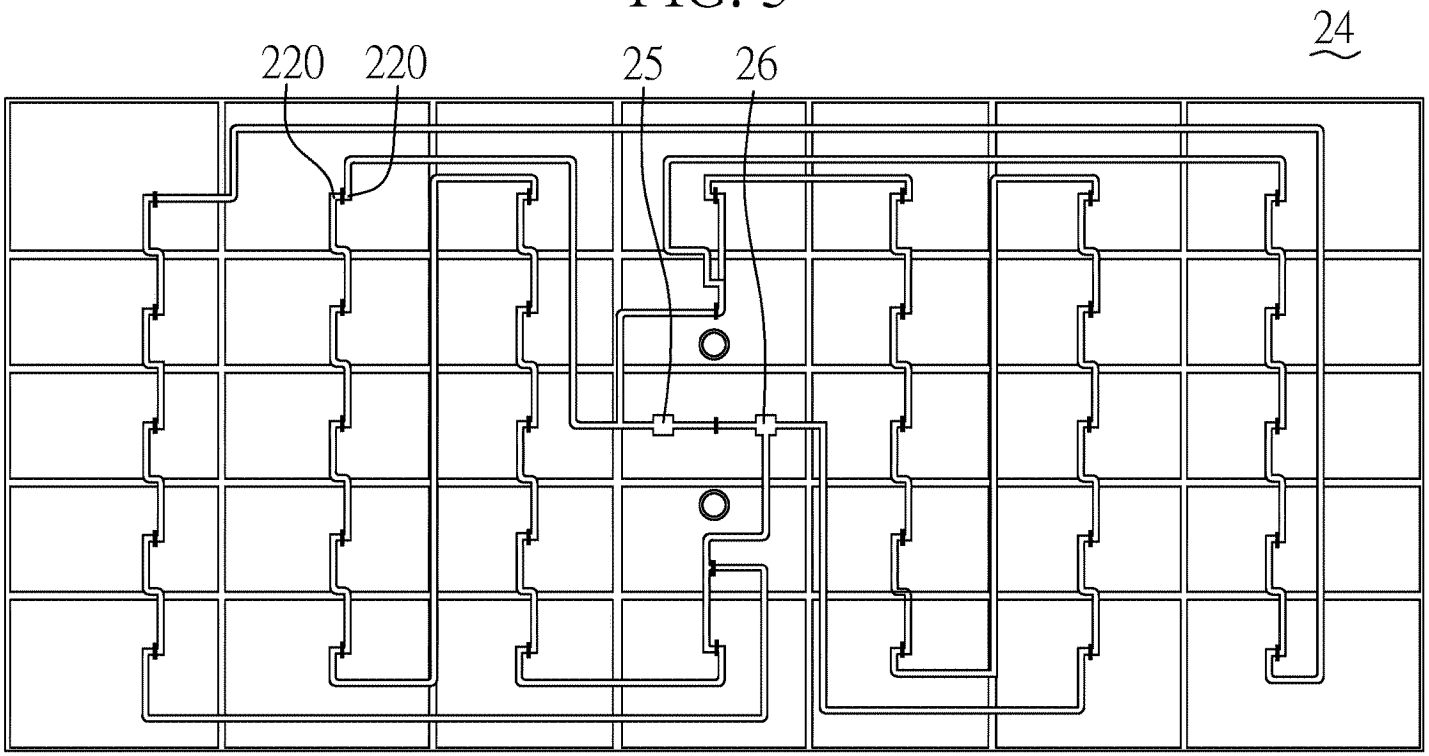
FIG. 6 shows a parallel circuit of the circuit layer of the light emitting diode plane source lamp according to the first embodiment of the present invention.

FIG. 5 shows a sectional view of the circuit board 20 of the light emitting diode plane source lamp 1 according to the first embodiment of the present invention. Each circuit board 20 includes a first insulating layer 21, a circuit layer 22 and a second insulating layer 23. Each circuit board 20 is fixed on the substrate 10 by the first insulating layer 21. The circuit layer 22 is set on the first insulating layer 21, and a parallel circuit 24 (as shown in FIG. 6) is disposed on the circuit layer 22. The parallel circuit 24 has a plurality of contacts 220. The second insulating layer 23 is set on the circuit layer 22 and has a plurality of via holes 230. The light emitting diodes 30 are set on the second insulating layer 22 and connected to the contacts 220 through the via holes 230.

Taking a matrix of 7 rows and 5 columns for example, FIG. 6 shows the parallel circuit 24 of the circuit layer 22 of the light emitting diode plane source lamp 1 according to the first embodiment of the present invention. The parallel circuit 24 has a positive terminal 25 and a negative terminal 26 connected to positive and negative wires 41, respectively. A first path 241, a second path 242 and a third path 243 are extended in parallel from the positive terminal 25. A fourth path 244, a fifth path 245 and a sixth path 246 are extended in parallel from the negative terminal 26. The first path 241 is connected to the fourth path 244, the second path 242 is connected to the fifth path 245, and the third path 243 is connected to the sixth path 246. With the aforementioned arrangement, it is easier to arrange the light emitting diodes 30 as a matrix of 7 rows and 5 columns. Preferably, the parallel circuit 24 has a plurality of zigzag portions where it encounters the contacts 220, so that the light emitting diodes 30 can be easily soldered at the zigzag portions.

It is noted that, since the circuit boards 30 are not adhesively assembled on the substrate 10, and become removable from the container space, replacements of the circuit boards 30 is possible once any of them is disabled, and the disabled one can be recycled. This is helpful for environmental protection.

Figure 7:
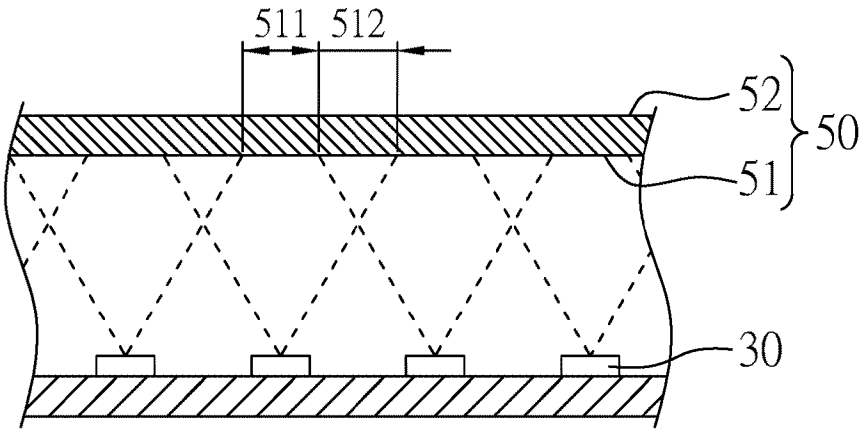
FIG. 7 shows a light projection of the light emitting diodes of the light emitting diode plane source lamp according to the first embodiment of the present invention.
Figure 8:
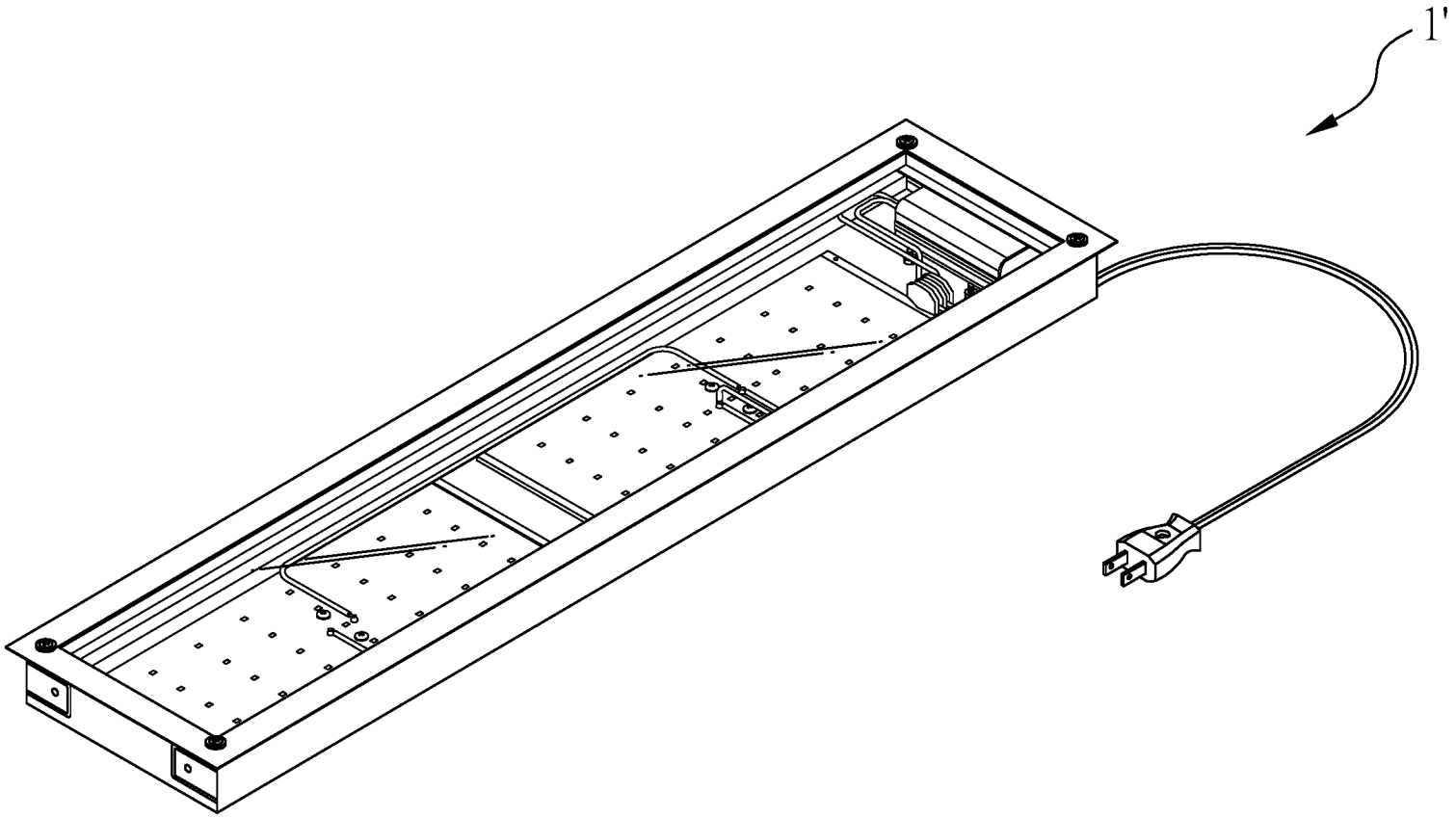
FIGS. 8 to 11 are a perspective view, an exploded view, a top perspective view and a bottom perspective view of a light emitting diode plane source lamp, respectively, according to a second embodiment according to the present invention.
Figure 9:
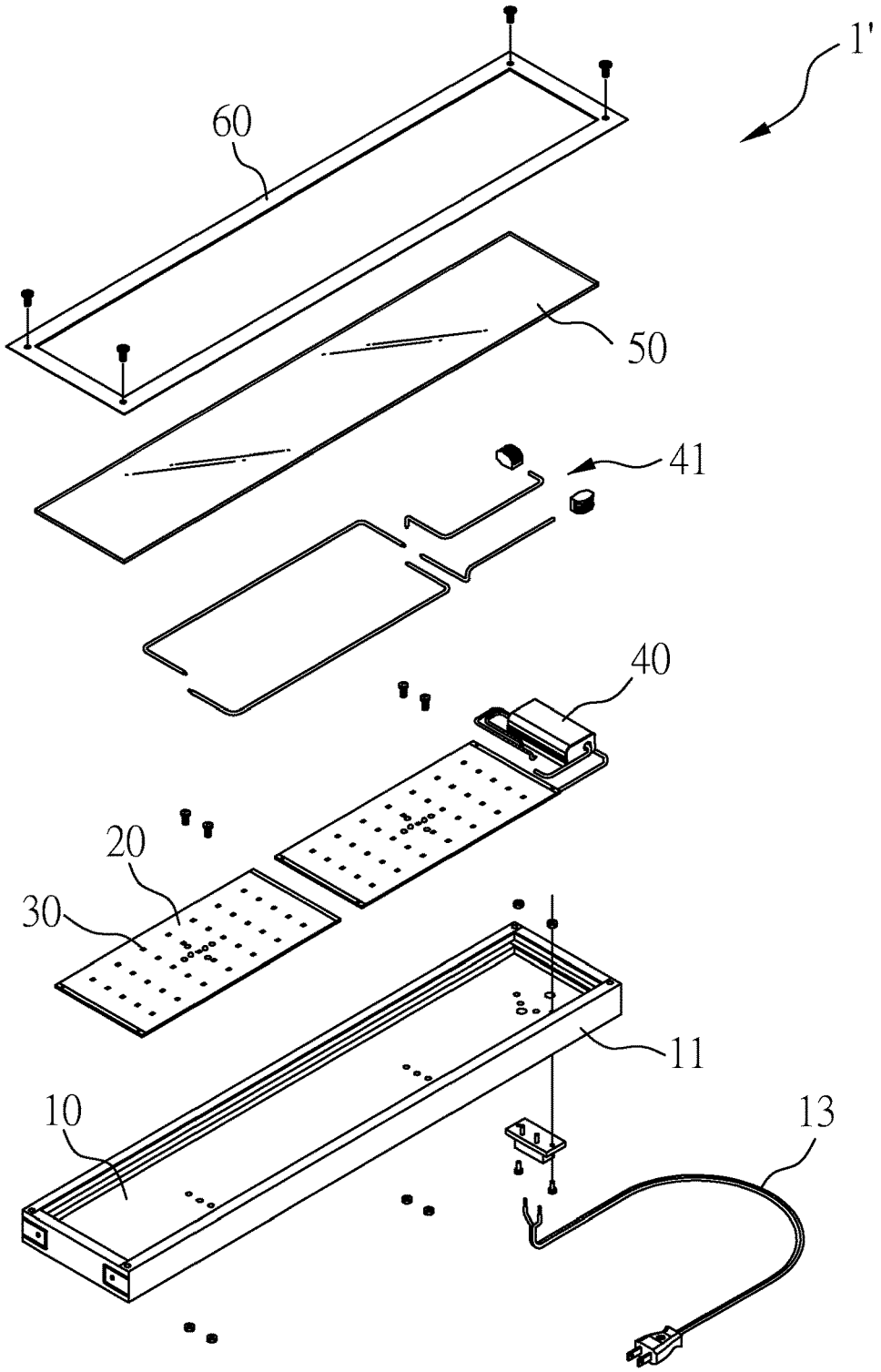
Figure 10:
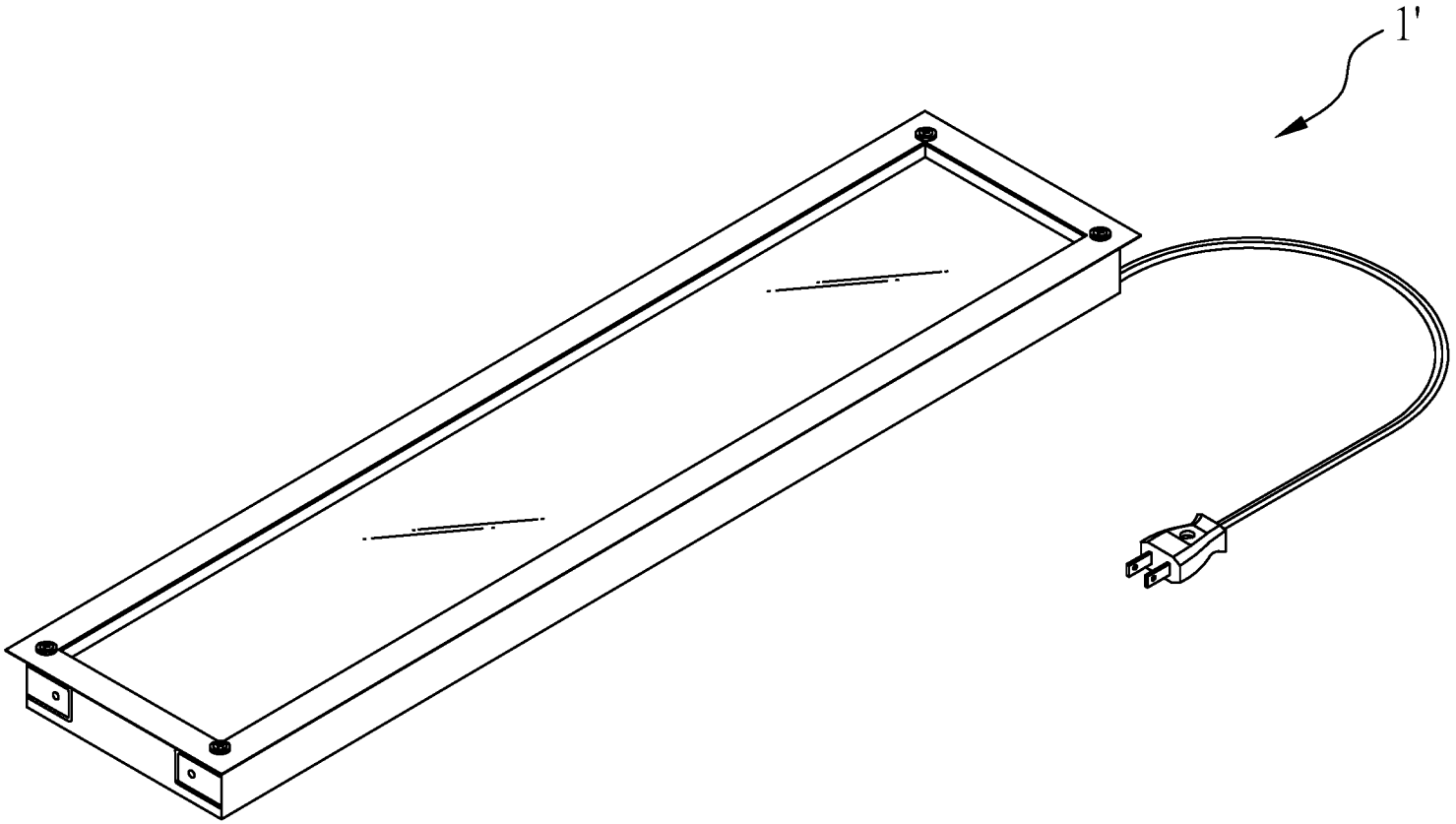
Figure 11:
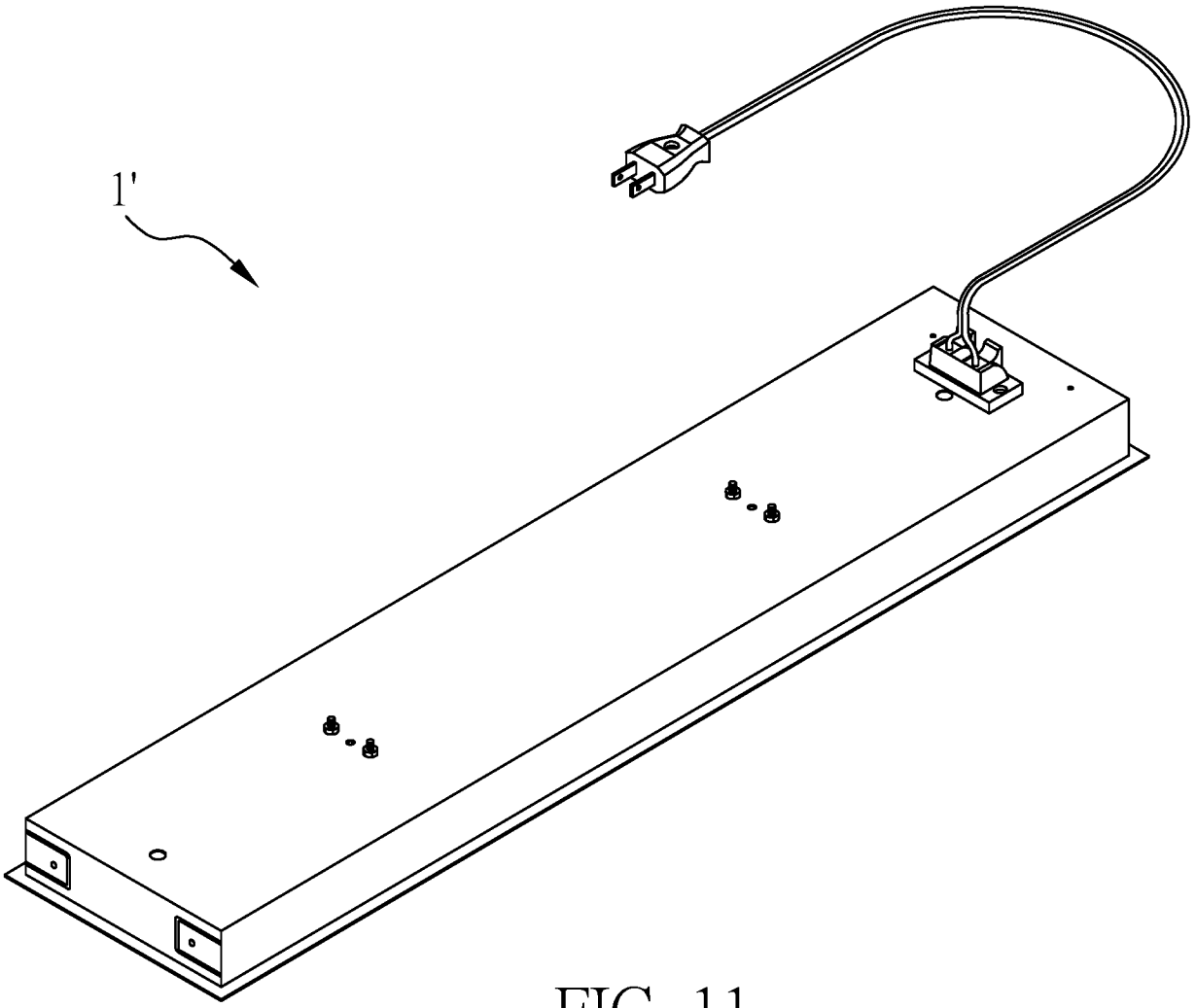
Figure 12:
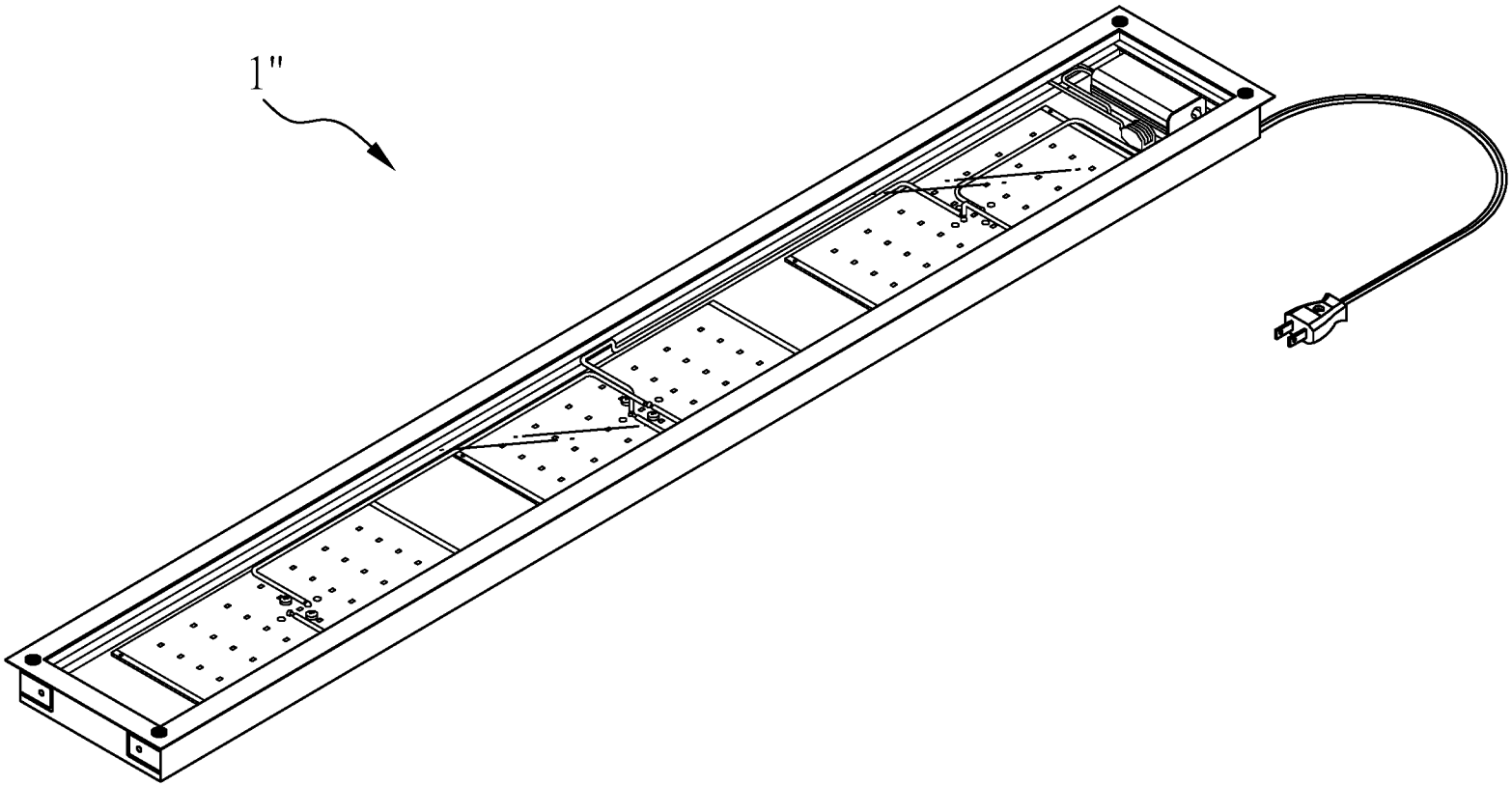
FIGS. 12 to 15 are a perspective view, an exploded view, a top perspective view and a bottom perspective view of a light emitting diode plane source lamp, respectively, according to a third embodiment according of the present invention.
Figure 13:
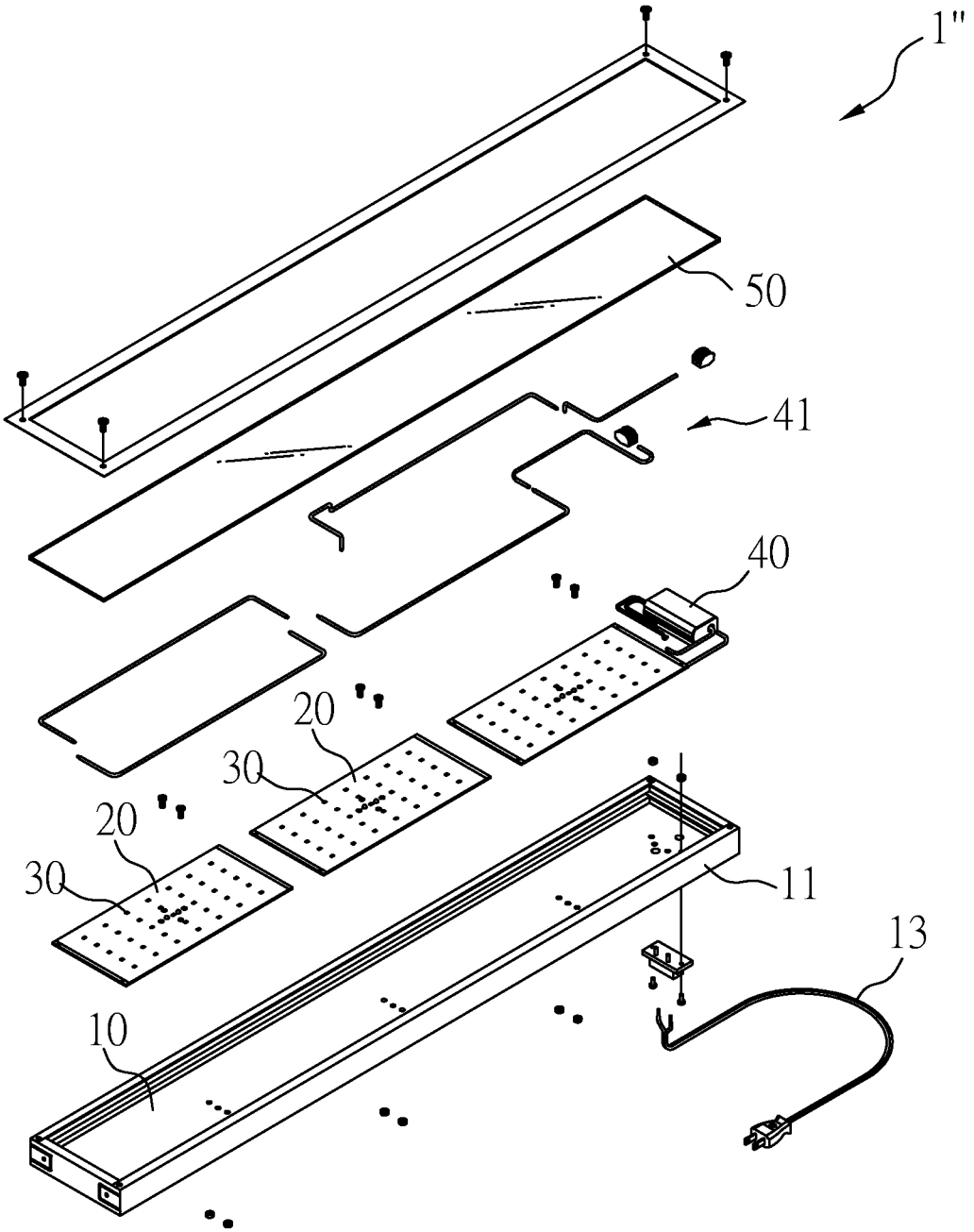
Figure 14:
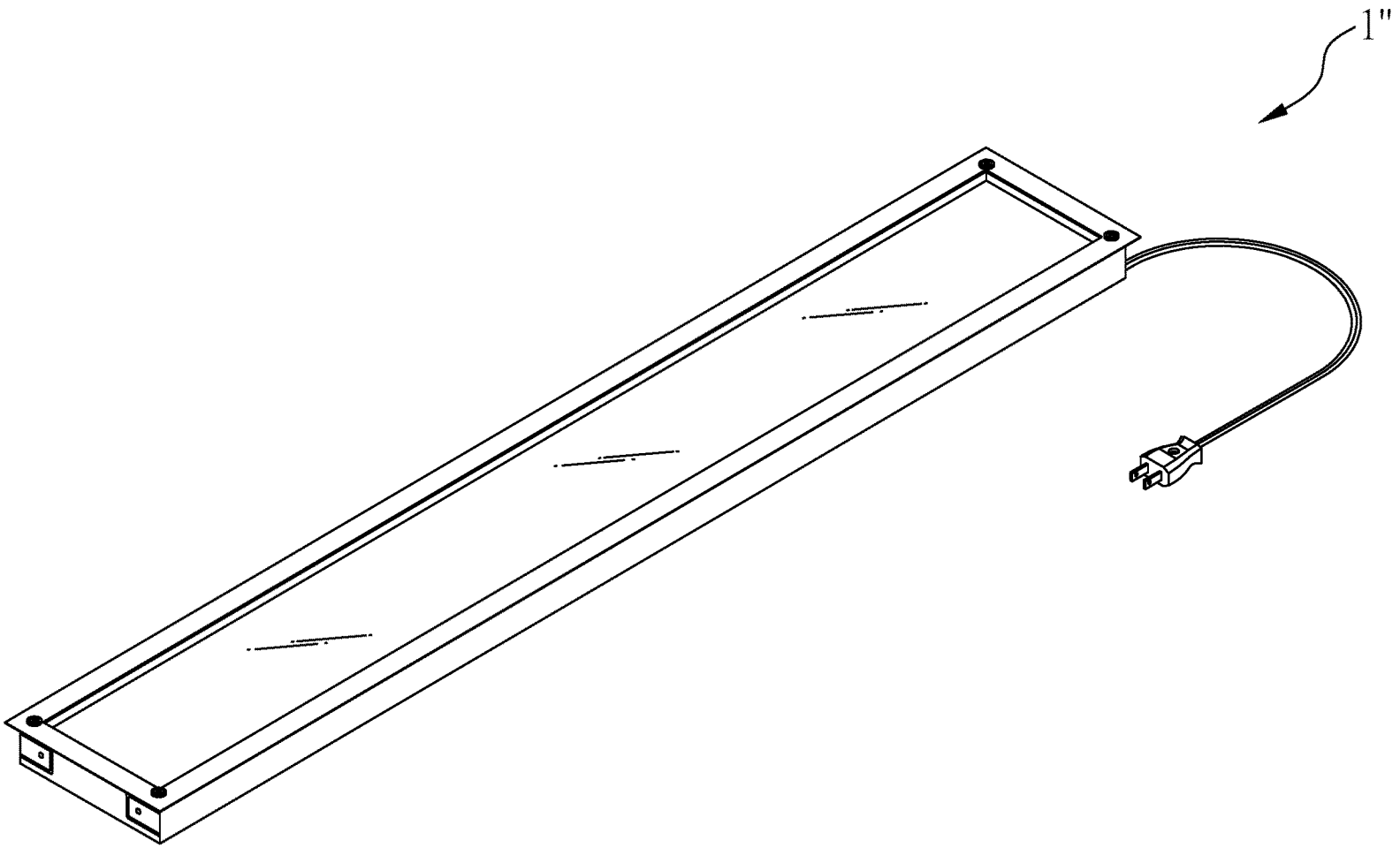
Figure 15:
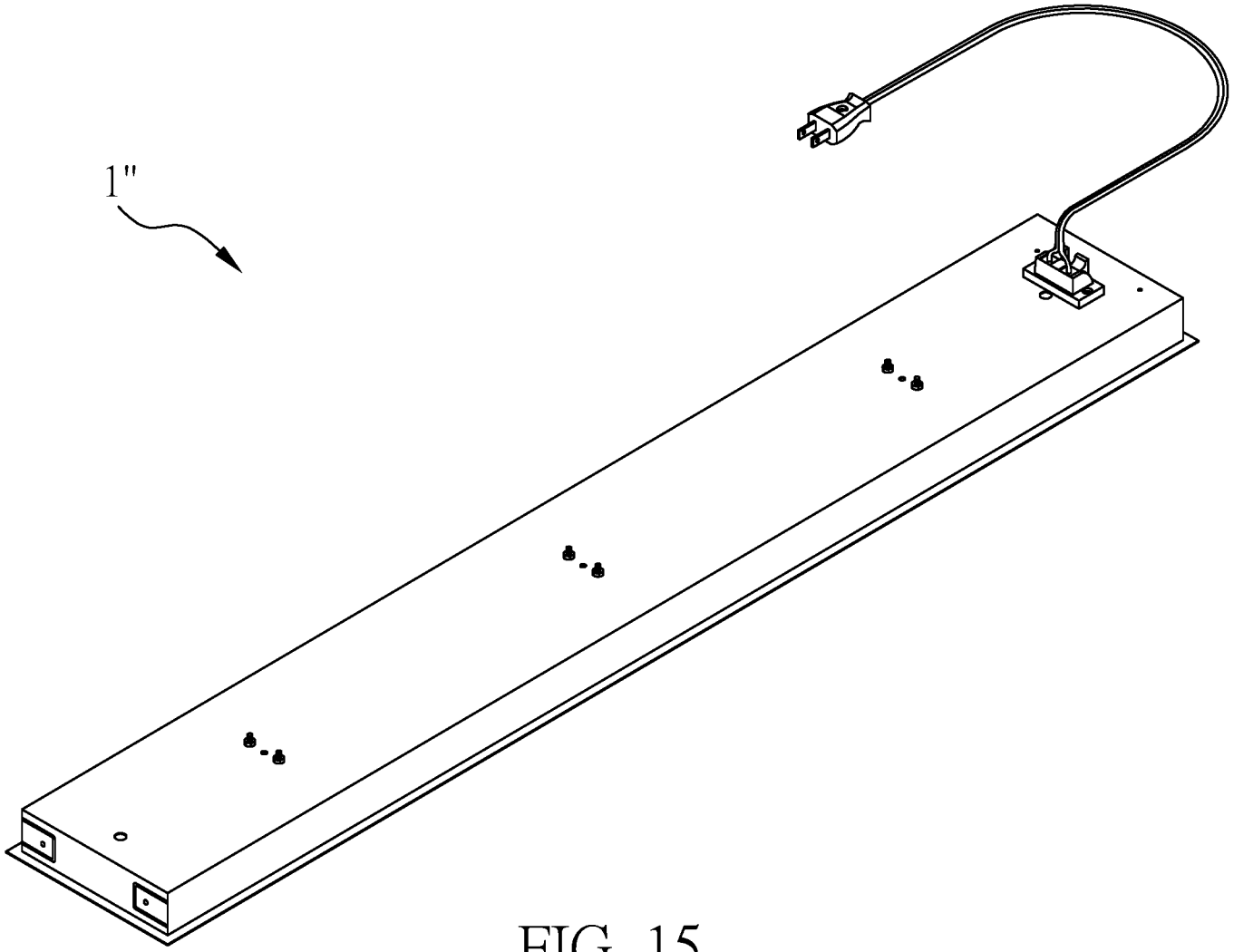
Figure 16:
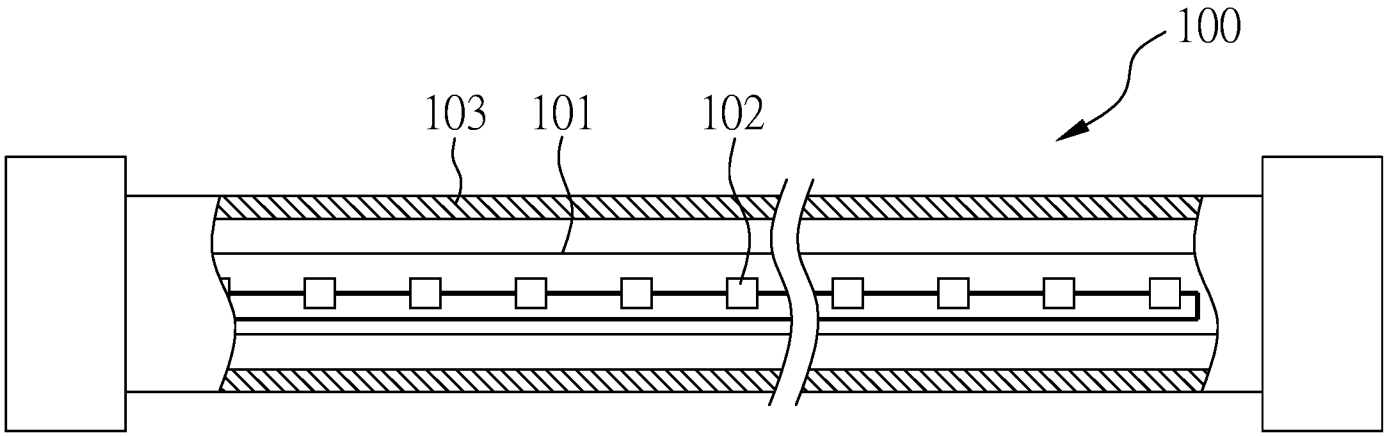
FIG. 16 (PRIOR ART)
FIG. 16 shows a prior art LED tube.

FIG. 7 shows a light projection of light emitting diodes 30 of the light emitting diode plane source lamp 1 according to the first embodiment of the present invention. The fogging film 50 scatters the lights of the light emitting diodes 30 to provide a uniform plane source. In particularly, fogging film. 50 includes an incident surface 51, that is, a proximal surface to the light emitting diode 30, and an emergent surface 52, that is, a distal surface to light emitting diode 30. It is noted that, the light emitting diodes 30 are located near the substrate 10, and there is a height H between the light emitting diodes 30 and the fogging film 50. Therefore, positions of the light emitting diodes 30 are arranged such that the lights emitted in different angles from the light emitting diodes 30 are superposed when projected on the incident surface of the fogging film 50, and result in a plurality of high illuminance areas 511 and a plurality of low illuminance areas 512. The lights are scattered in the fogging film 50, and since the light in the high illuminance areas 511 has higher scattering expectance than the light in the low illuminance areas 512 does, the fogging film can uniform the light from both areas, and provide a plane source in the emergent surface 52.

In the present invention, it is noted that, the fogging film 50 has a non-linear relation between an illuminance E of the incident surface 51 and a luminous exitance M of the emergent surface 52. It is noted that, the illuminance E is defined as the luminous flux per unit area received by the incident surface 51 of the fogging film 50, and the luminous exitance M is defined as the luminous flux per unit area emitted by the emergent surface 52 of the fogging film 50. Such non-linear relation cannot be expressed as an analytic solution, but can be expressed with characteristic of maximum.

In particular, the parameters determining the illuminance E of the incident surface includes the radiant flux W of each light emitting diode 30, the distance D spacing out any two adjacent light emitting diodes 30, and the height H between the light emitting diodes 30 and the fogging film 50, because the illuminance E is obtained by integrating the luminous flux with respect to the incident angles on a unit area, wherein the luminous flux is proportional to the radiant flux W, and the incident angle is the arctangent of a ratio of the distance D and the height H.

Moreover, as discussed above, in the present invention, it is noted that the fogging film 50 has a non-linear relation between the illuminance E of the incident surface 51 and the luminous exitance M of the emergent surface 52, and thus the luminous exitance M of the superposition of the lights emitted from the light emitting diodes 30 passing through the fogging film 50 can be expressed as a non-linear function F with respect to the radiant flux W, the distance D or the height II, and that the non-linear function F converges to a maximum U. That is to say, the non-linear function F is a convergent function and does not diverge to infiniteness. Furthermore, at least one part of the non-linear function F is a quadratic function.

It is noted that, the maximum U of the non-linear function F depends on the material of the fogging film 50, or in other words, fogging films 50 of different materials have different maxima U. In this embodiment, the fogging film 50 is a polycarbonate (PC) film. In other embodiments, the fogging film 50 can be an acrylic film.

Therefore, in the present invention, the radiant flux W, the distance D or the height H is adjusted such that the non-linear function F becomes the maximum U. Accordingly, the present invention obtains that, the ratio of the radiant flux W:the distance D:the height is preferred to be 0.2 Watt:1.5 cm:3 cm, so that the non-linear function F can be the maximum U. Therefore, for the light emitting diodes 30, it is preferred that the radiant flux W is 0.2 Watt, the distance D is 1.5 cm and the height H from a light emitting diode 30 to the fogging film 50 is 3 cm; or the radiant flux W is 0.3 Watt, the distance D is 2.25 cm, the height H from a light emitting diode 30 to the togging film 50 is 4.5 cm, and so on. The height H is preferably 0.5 to 5 cm.

In measurement, the luminous exitance M of the light emitting diode plane source lamp 1 of the present invention is 800 lx (lx=lx·m$^{-2}$), which conforms to the indoor lighting standards.

It is important to have the aforementioned ratio relation. Since the light emitting diodes have to be arranged as a matrix to provide a plane source, if the aforementioned ratio relation is applied, the luminous efficacy of the plane source lamp can be increased. In contrast, if another ratio relation instead of the aforementioned ratio relation is applied, the luminous efficacy of the plane source lamp cannot be optimized, resulting in energy waste and waste heat.

Second Embodiment

FIGS. 8 to 11 are a perspective view, an exploded view, a top perspective view and a bottom perspective view of a light emitting diode plane source lamp 1', respectively, according to a second embodiment of the present invention. In this embodiment, the substrate 10 is longitudinally lengthened to contain two circuit boards 20. Except for the substrate 10, the components and the arrangement thereof are referred to the first embodiment.

One circuit board 20 having 35 light emitting diodes 30 only consumes electrical power of 5 Watts up to 10 Watts, preferably, 7.5 Watts, and in this embodiment, two circuit boards 20 each having 35 light emitting diodes 30 only consume electrical power of 15 Watts. It shows that the present invention saves more electrical power than the prior art does. The temperature of the circuit board is about 25° C., which is lower than the temperature of the prior art LED tube.

Third Embodiment

FIGS. 12 to 15 are a perspective view, an exploded view, a top perspective view and a bottom perspective view of a light emitting diode plane source lamp 1", respectively, according to a third embodiment of the present invention. In this embodiment, the substrate 10 is longitudinally lengthened to contain three circuit boards 20. Except for the substrate 10, the components and the arrangement thereof are referred to the first embodiment.

In measurement, three circuit boards 20 each having 35 light emitting diodes 30 only consumes electrical power of 20 Watts. It shows that the present invention saves more electrical power than the prior art does. The temperature of the circuit board is about 25° C., which is lower than the temperature of the prior art LED tube.

In conclusion, the light emitting diode plane source lamp of the present invention can provide uniform plane source. In addition, in the present invention, it is noted that the fogging film 50 has a non-linear relation between the illuminance E of the incident surface and the luminous exitance M of the emergent surface, and that the luminous exitance M of the fogging film 50 can be optimized by adjusting relevant parameters.

Although the present invention has been explained in relation to its preferred embodiments, it is to be understood that many other possible modifications and variations can be made without departing from the spirit and scope of the invention as hereinafter claimed.

What is claimed is:

1. A light emitting diode plane source lamp, comprising:

a substrate;

four side plates respectively set on four sides of the substrate and perpendicular to the substrate;

a plurality of circuit boards symmetrically set on the substrate and connected to each other in parallel;

a plurality of light emitting diodes set on each circuit board and arranged as a matrix on each circuit board;

a power supplier set on the substrate and providing electrical power to the light emitting diodes; and a fogging film set on the side plates and opposite to the substrate;

wherein the fogging film scatters the lights of the light emitting diodes to provide a uniform plane source;

wherein the fogging film includes an incident surface and an emergent surface; wherein positions of the light emitting diodes are arranged such that the lights emitted from the light emitting diodes are superposed on the incident surface, and result in high illuminance areas and low illuminance areas on the incident surface; the fogging film scatters the lights in the high illuminance areas and the low illuminance areas to uniform the lights, and provides plane source on the emergent surface;

wherein each light emitting diode has a radiant flux of W; any two adjacent light emitting diodes are spaced out by a distance D; the fogging film and the light emitting diodes are spaced out by a height H; and a luminous exitance of the superposition of the lights emitted from the light emitting diodes passing through the fogging film is a quadratic function with respect to the radiant flux W, the distance D or the height H; and wherein the radiant flux W, the distance D or the height H is chosen such that the quadratic function converges to a maximum.

2. The light emitting diode plane source lamp as claimed in claim 1, wherein a ratio of the radiant flux W:the distance D:the height is 0.2 Watt:1.5 cm:3 cm.

3. The light emitting diode plane source lamp as claimed in claim 2, wherein the height H is 0.5 to 5 cm.

4. The light emitting diode plane source lamp as claimed in claim 3, wherein the fogging film is a polycarbonate film or an acrylic film.

5. The light emitting diode plane source lamp as claimed in claim 4, wherein each circuit board includes:

a first insulating layer;

a circuit layer set on the first insulating layer, wherein a parallel circuit having a plurality of contacts is disposed on the circuit layer; and a second insulating layer set on the circuit layer and having a plurality of via holes, wherein the light emitting diodes are set on the second insulating layer and connected to the contacts through the via holes.

6. The light emitting diode plane source lamp as claimed in claim 5, wherein the parallel circuit has a plurality of zigzag portions where it encounters the contacts.

7. The light emitting diode plane source lamp as claimed in claim 5, wherein the parallel circuit includes:

a positive terminal;

a negative terminal;

a first path, a second path and a third path extended in parallel from the positive terminal; and a fourth path, a fifth path and a sixth path extended in parallel from the negative terminal;

wherein the first path is connected to the fourth path, the second path is connected to the fifth path, and the third path is connected to the sixth path.

* * * * *